US011030972B2

(12) United States Patent
Kwon et al.

(10) Patent No.: US 11,030,972 B2
(45) Date of Patent: Jun. 8, 2021

(54) ELECTRONIC DEVICE AND METHOD FOR CONTROLLING SAME

(71) Applicant: SAMSUNG ELECTRONICS CO., LTD., Suwon-si (KR)

(72) Inventors: Oh-jae Kwon, Suwon-si (KR); Seung-jin Baek, Suwon-si (KR); Ho-sik Sohn, Seoul (KR); Ho-young Lee, Suwon-si (KR); Kil-soo Jung, Osan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/638,980

(22) PCT Filed: Sep. 7, 2018

(86) PCT No.: PCT/KR2018/010469

§ 371 (c)(1),
(2) Date: Feb. 13, 2020

(87) PCT Pub. No.: WO2019/066296

PCT Pub. Date: Apr. 4, 2019

(65) Prior Publication Data

US 2020/0202809 A1 Jun. 25, 2020

(30) Foreign Application Priority Data

Sep. 28, 2017 (KR) ..... 10-2017-0125813

(51) Int. Cl.
*G09G 5/02* (2006.01)
*G09G 3/20* (2006.01)

(52) U.S. Cl.
CPC ..... *G09G 5/02* (2013.01); *G09G 3/2003* (2013.01); *G09G 2320/0666* (2013.01)

(58) Field of Classification Search
CPC ..... G09G 5/02
See application file for complete search history.

(56) References Cited

U.S. PATENT DOCUMENTS 8,125,696 B2 2/2012 Manabe
8,746,922 B2 6/2014 Habers et al.
(Continued)

FOREIGN PATENT DOCUMENTS

JP 2003-346137 A 12/2003
JP 2006-189445 A 7/2006
(Continued)

OTHER PUBLICATIONS

International Search Report (PCT/ISA/210), issued by International Searching Authority in corresponding International Application No. PCT/KR2018/0104169, dated Dec. 13, 2018.
(Continued)

*Primary Examiner* — Roy P Rabindranath
(74) *Attorney, Agent, or Firm* — Sughrue Mion, PLLC

(57) ABSTRACT

An electronic device is disclosed. The electronic device includes a sensor, a storage unit for storing a color matching function (CMF), which has been pre-defined according to characteristics of a light source, and a processor for acquiring spectral information regarding at least one pixel of a display panel by using a sensor, for acquiring color stimulus values regarding at least one pixel on the basis of the stored CMF and the acquired spectral information, and for acquiring a correction coefficient regarding at least one pixel of the display panel on the basis of the acquired color stimulus values.

10 Claims, 11 Drawing Sheets

(56) References Cited

U.S. PATENT DOCUMENTS

| | | | | |
|---|---|---|---|---|
| 9,055,622 | B2 | 6/2015 | Aldrich et al. | |
| 9,407,792 | B2 | 8/2016 | Takahashi | |
| 2004/0017379 | A1 | 1/2004 | Ajito et al. | |
| 2006/0146330 | A1 | 7/2006 | Maniam | |
| 2009/0067016 | A1* | 3/2009 | Manabe | H04N 1/46 358/518 |
| 2015/0281522 | A1* | 10/2015 | Takahashi | H04N 1/6086 358/1.9 |
| 2018/0047325 | A1* | 2/2018 | Biwa | G09G 3/32 |

FOREIGN PATENT DOCUMENTS

| | | | |
|---|---|---|---|
| JP | 2008-306391 | A | 12/2008 |
| JP | 5111295 | B2 | 1/2013 |
| JP | 2015-148757 | A | 8/2015 |
| JP | 2015-188131 | A | 10/2015 |
| JP | 2016-173468 | A | 9/2016 |
| KR | 10-2013-0095266 | A | 8/2013 |
| KR | 10-1705818 | B1 | 2/2017 |

OTHER PUBLICATIONS

Written Opinion (PCT/ISA/237) issued by the International Searching Authority in corresponding International Application No. PCT/KR2018/0104169, dated Dec. 13, 2018.

* cited by examiner $$X = \int_0^\infty I(\lambda)\,\bar{x}(\lambda)\,d\lambda$$

$$Y = \int_0^\infty I(\lambda)\,\bar{y}(\lambda)\,d\lambda$$

$$Z = \int_0^\infty I(\lambda)\,\bar{z}(\lambda)\,d\lambda$$

ELECTRONIC DEVICE AND METHOD FOR CONTROLLING SAME

TECHNICAL FIELD

The disclosure relates to an electronic device and a method for controlling thereof and more particularly, to an electronic device capable of measuring chromaticity and luminance of a display and a method for controlling thereof.

BACKGROUND ART

The display device includes a display panel for displaying an image, and is a device capable of displaying an image based on broadcast signals or image signals/image data of various formats, and is implemented as a TV or a monitor. The display panel is implemented in various types, such as liquid crystal panels, plasma panels, or the like, according to characteristics thereof, and is applied to various display devices.

However, differences between luminance and chromaticity, which is a light output of each pixel, are occurred in a displayed image due to problems of its electrical, physical and optical characteristics and a problem in processing. Accordingly, even if the same broadcast program is provided to the display device through public air or satellite, the color of the broadcast program shown on the display device slightly may vary depending on the display device.

In addition, if the light output of each pixel of high resolution display device is not uniform with each other, problems such as screen blur, or the like may occur.

In order to solve this problem, chromaticity and luminance regarding each pixel of the display panel have heretofore been measured using a color measuring instrument capable of measuring the chromaticity and luminance, and have been corrected the chromaticity and luminance of the display panel in the method chromaticity and luminance method.

However, the conventional color measuring instrument should have a color filter for various types of light sources such as LED, tungsten, or the like, and there has been a difficulty in measuring chromaticity and luminance of other types of light sources other than the light source of the type corresponding to the color filter. If the measured chromaticity and luminance are inaccurate, it may not implement satisfactory luminance and chromatic uniformity even if correction is properly performed.

DETAILED DESCRIPTION OF THE INVENTION

Technical Problem

The disclosure provides an electronic device capable of accurately measuring chromaticity and luminance of various types of light sources to solve the problems described above and a method for controlling thereof.

Technical Solution

An electronic device according to an embodiment of the disclosure comprises a sensor, a storage unit storing a color matching function (CMF), which has been pre-defined according to characteristics of a light source, and a processor configured to: acquire spectral information regarding at least one pixel of a display panel by using the sensor, acquire color stimulus values regarding the at least one pixel on the basis of the stored CMF and the acquired spectral information, and acquire a correction coefficient regarding at least one pixel of the display panel on the basis of the acquired color stimulus values.

The storage unit may be configured to store a CMF pre-defined by type of light source having different characteristics, and wherein the processor may be configured to select a CMF corresponding to a light source of the display panel among the stored CMFs, and acquire color stimulus values regarding the at least one pixel on the basis of the selected CMF and the acquired spectral information.

Also, the storage unit may be configured to further store light source spectral information pre-defined by type of light source having different characteristics, and wherein the processor may be configured to select one light source spectral information among the stored light source spectral information on the basis of a correlation between spectral information regarding the acquired at least one pixel and the stored light source spectral information, and select a CMF of a light source corresponding to the selected light source spectral information as a CMF corresponding to a light source of the display panel.

The electronic device of claim 2 may further include an input unit, wherein the processor may be configured to select a CMF selected according to a user input input through the input unit among the stored plurality of CMFs as a CMF corresponding to the light source of the display panel.

The processor may be configured to, on the basis of the color stimulus values regarding the acquired at least one pixel and a preset target color stimulus value, calculate correction coefficients for correcting color stimulus values regarding the acquired at least one pixel and store the calculated correction coefficients in the storage unit.

The processor may be configured to acquire the color stimulus values regarding the at least one pixel by adding up a multiplication of the color stimulus values of the stored CMF and the color stimulus values of the acquired spectral information.

The at least one pixel may be configured to include point light sources corresponding to red (R), green (G), blue (B), respectively, and wherein the processor may be configured to acquire spectral information and color stimulus values regarding the R, G, and B, respectively.

A method for controlling electronic device according to an embodiment of the disclosure may include acquiring spectral information regarding at least one pixel of a display panel, acquiring color stimulus values regarding the at least one pixel on the basis of a CMF which has been pre-defined according to characteristics of a light source of the display panel and the acquired spectral information, and acquiring a correction coefficient regarding at least one pixel of the display panel on the basis of the acquired color stimulus values.

The acquiring the color stimulus values may include selecting a CMF corresponding to a light source of the display panel among CMFs pre-defined by type of light source having different characteristics, and acquiring color stimulus values regarding the at least one pixel on the basis of the selected CMF and the acquired spectral information.

The selecting may include, on the basis of a correlation between spectral information regarding the acquired at least one pixel and light source spectral information pre-defined by type of light source having different characteristics, selecting one light source spectral information among the pre-defined light source spectral information and selecting a CMF corresponding to the selected light source spectral information as a CMF corresponding to a light source of the display panel.

The selecting may include selecting a CMF selected according to a user input among the stored plurality of CMFs as the CMF corresponding to the light source of the display panel.

The acquiring the correction coefficient may include calculating a correction coefficient for correcting color stimulus values regarding the acquired at least one pixel by the pixel unit on the basis of color stimulus values regarding the acquired at least one pixel and a preset target color stimulus value.

The acquiring color stimulus values may include acquiring the color stimulus values rewarding the at least one pixel by adding up a multiplication of the color stimulus value of the stored CMF and the color stimulus value of the acquired spectral information by a preset wavelength unit.

The at least one pixel may include point light sources corresponding to red (R), green (G), and blue (B), respectively, wherein the acquiring the color stimulus values may include acquiring spectral information and color stimulus values regarding the R, G, and B, respectively.

Effect of the Invention

According to various embodiments of the disclosure, a physical color filter is not required, thereby reducing costs, and chromatic/luminance deviation of a display can be corrected by easily changing a CMF for each light source type of the display, thereby increasing convenience.

BEST MODE FOR IMPLEMENTING THE DISCLOSURE

Mode for Implementing the Disclosure

Figure 1:
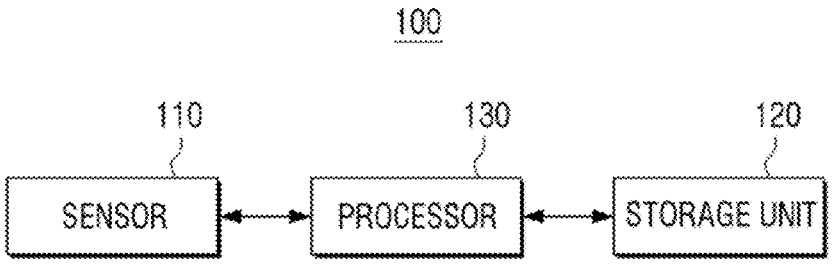
FIG. 1 is a block diagram schematically illustrating a configuration of an electronic device according to an embodiment.

Before specifically describing the present disclosure, a method for demonstrating the present specification and drawings will be described.

First, as terms used in the present specification and claims, general terms have been selected by considering functions in diverse exemplary embodiments. However, such terms may be varied depending on an intention of those skilled in the art, a legal or technical interpretation, an emergence of a new technology, and the like. Further, some terms may be terms which are arbitrarily selected by an applicant. Such terms may be construed according to meanings defined in the present specification, and may also be construed based on general contents of the present specification and a typical technical concept in the art unless the terms are not specifically defined.

Further, the same reference numerals or symbols described in the accompanying drawings of the present specification denote parts or components that perform substantially the same function. For convenience of explanation and understanding, the description will be provided using the same reference numerals or symbols in different exemplary embodiments. That is, although a plurality of drawings may illustrate the components having the same reference numeral, the plurality of drawings do not mean one exemplary embodiment.

In addition, in order to distinguish between the components, terms including an ordinal number such as "first", "second", etc. may be used in the present specification and claims. The ordinal number is used to distinguish the same or similar components from each other, and the meaning of the terms should not be construed as being limited due to the usage of the above-mentioned ordinal number. As an example, the components coupled to the ordinal number should not be construed as a use order, a layout order, or the like being limited by the number. The respective ordinal numbers are interchangeably used, if necessary.

In the present specification, the singular expression includes the plural expression unless the context clearly indicates otherwise. In the present application, the terms "include" and "consist of" designate the presence of features, numbers, steps, operations, components, elements, or a combination thereof that are written in the specification, should be understood that they do not exclude the presence or possibility of addition of one or more other features, numbers, steps, operations, components, elements, or a combination thereof.

A term "module", "unit", "part", or the like, in the exemplary embodiment of the present disclosure is a term for referring to the component performing at least one function or operation, and such component may also be implemented in hardware or software or a combination of hardware and software. In addition, a plurality of "modules", "units", "parts", or the like may be integrated into at least one module or chip and may be implemented in at least one processor (not illustrated), except for a case in which they need to be each implemented in individual specific hardware.

In addition, in the exemplary embodiment of the present disclosure, it will be understood that when an element is referred to as being "connected to" another element, it can be directly "connected to" the other element or other elements intervening therebetween may be present. In addition, unless explicitly described otherwise, "comprising" any components will be understood to imply the inclusion of other components rather than the exclusion of any other components.

Hereinafter, embodiments of the present disclosure will be explained with reference to the drawings.

FIG. 1 is a block diagram schematically illustrating a configuration of an electronic device according to an embodiment.

The electronic device 100 of the disclosure is a device measuring chromaticity and luminance of the display panel 200. The electronic device 100 may include a sensor 110 for detecting a spectrum of the display panel 200, a storage unit 120 for storing a color matching filter (CMF) pre-defined according to characteristics of a light source, color stimulus values calculated according to detected chromaticity and luminance, and a correction coefficient for calibrating the color stimulus values, and a processor 130 for overall control of the electronic device 100.

Firstly, the sensor 110 may be configured to acquire the spectral information of the light emitted from each pixel by sensing intensity and wavelength of the light emitted from each pixel constituting the display panel 200. Each pixel constituting the display panel 200 may be a point light source with a self-luminous type, and the point light source may output R (Red), G (Green), and B (Blue), respectively. The sensor 110 may detect the RGB color of each point light source. The sensor 110 may be implemented as an image sensor such as a CMOS or a CCD, or may be implemented as a optical sensor.

The storage unit 120 may be a component for storing the color matching function (CMF) corresponding to the light source to be measured. The CMF is a function used in the process of measuring to equalize the luminance and chromaticity in the display of a specific light source, and is numerical definition of a standard observer's color response. A CIE XYZ color space may be expressed as a combination of three color stimulus values X, Y, and Z: blue, green, and red, and the CMF is defined as the response function x (λ), y (λ), z (λ) of cone cells to X, Y and Z, respectively.

Figure 2:
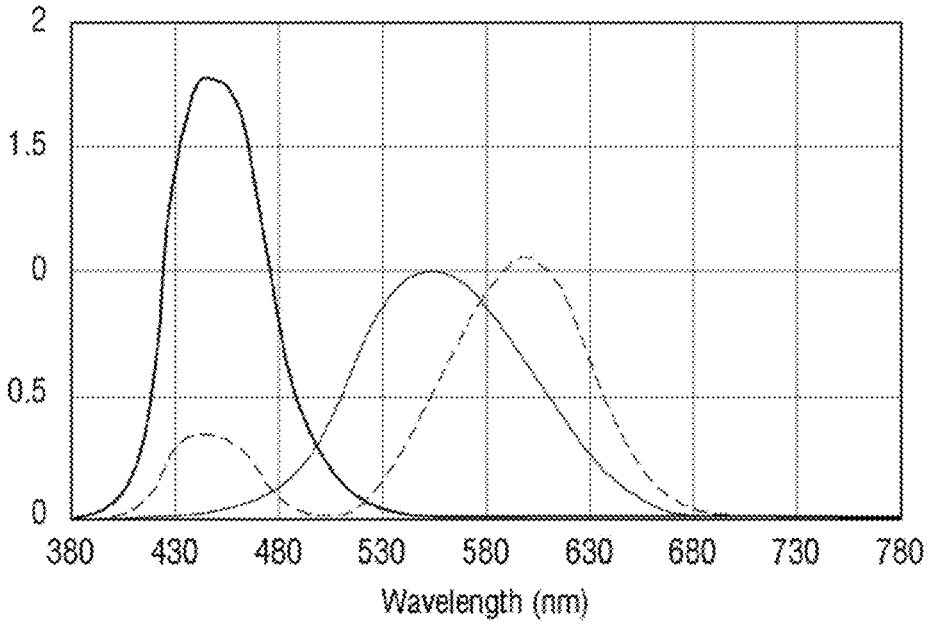
FIG. 2 is a view illustrating a graph of a CMF.

Referring to FIG. 2, a spectral graph according to CMF is defined at a wavelength of about 340 nm to 800 nm, and x-axis represents a wavelength of light and y-axis represents the color stimulus values. FIG. 2 illustrates the spectral graph according to CMF (CIE-1931 CMF) defined according to the XYZ color space established in 1931 at CIE.

The storage unit 120 may store data in which a wavelength of the CMF is matched with the color stimulus values for each predetermined unit of a wavelength such as 1 nm unit or 5 nm unit of the CMF. Data in which the wavelength and color stimulus values of the CMF are matched may be stored in the form of a look-up table.

Meanwhile, the CMF may be differently defined according to the type of light source. As various light sources for displays have been developed, the luminance and chromaticity of the display may be able to be more accurately uniformed by using the color stimulus values X, Y, and Z measured using CMF corresponding to the characteristics of each light source. In particular, when it comes to a light source having a narrow half-width, a difference between the spectral graph and visual recognition characteristics have been occurred according to CIE-1931 CMF, so that a CMF suitable for each type of light source was defined.

Accordingly, the storage unit 120 may store a plurality of different CMFs pre-defined by type of light source to be measured.

The storage 120 may be realized as one of a hard disk drive (HDD), a solid state drive (SSD), a dynamic RAM (DRAM) memory, a static RAM (SRAM) memory, a ferroelectric RAM (FRAM) memory, a flash memory, or the like.

Meanwhile, the processor 130 controls the overall operations of the electronic device 100. Specifically, the processor 130 may acquire spectral information regarding at least one pixel of the display panel 200 by using the sensor 110, and the color stimulus values X, Y, and Z may be acquired for R, G, and B regarding at least one pixel, respectively, according to the acquired spectral information. Specific explanation thereof will be made hereinafter with reference to FIGS. 5A to 5C.

Figure 3:
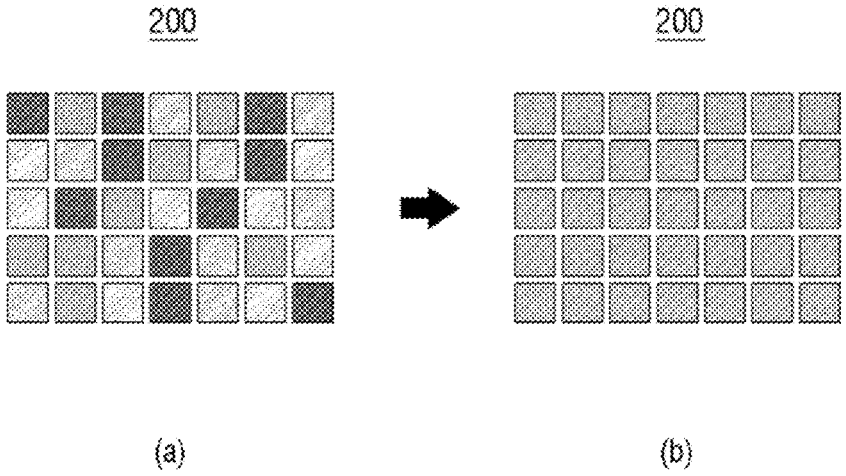
FIG. 3 is a view illustrating luminance/chromatic deviations according to a characteristic difference of a point light source and a part of the display in which the luminance/chromatic deviations corrected.

FIG. 3 is a view illustrating luminance/chromatic deviations according to a characteristic difference of a point light source and a part of the display in which the luminance/chromatic deviations corrected.

Respective self-luminous light sources constituting the display panel 200 may be different in their characteristics of chromaticity and luminance in a process of processing. Accordingly, even if the same RGB values are output as shown in FIG. 3(A), chromaticity and luminance perceived by human eyes for each pixel may all be different.

Figure 4:
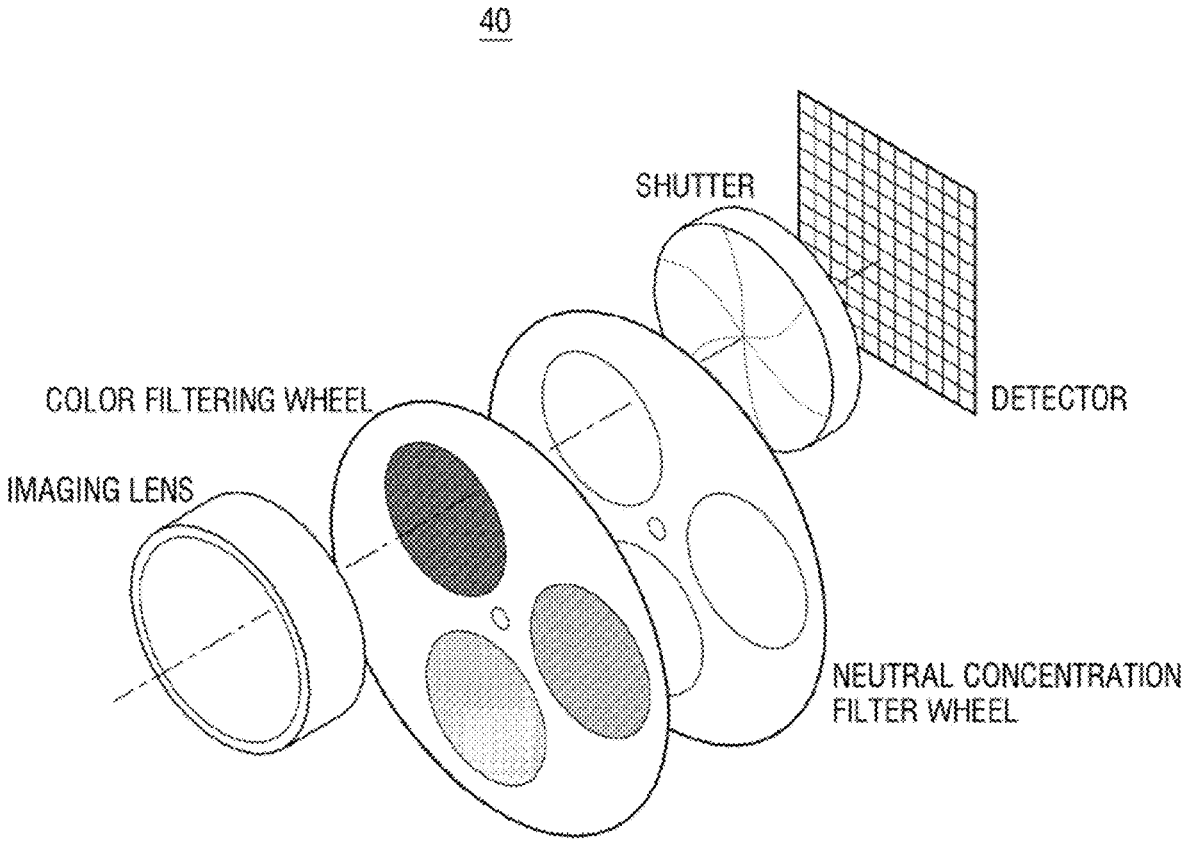
FIG. 4, with respect to conventional art, is a view illustrating a method how color stimulus values are measured through a colorimeter implemented by a color filter that a CMF is reelected.

Accordingly, a process is required to uniformly correct chromaticity and luminance of each pixel of the display panel 200, as shown in FIG. 3B, and the conventional luminance/chromatic correction was performed through a colorimeter. The conventional colorimeter includes a sensor 40 capable of sensing chromaticity and luminance for each pixel of the display panel 200, as shown in FIG. 4.

The sensor 40 may include an imaging lens, a color filter wheel, a neutral density filter wheel, a shutter, and a CCD detector, and the colorimeter may use such sensors to measure XYZ values for R, G, and B regarding each pixel of the display panel 200, respectively.

Based on the measured XYZ value and a preset target XYZ value (reference XYZ value), a correction coefficient (3×3 matrix data) may be calculated to correct the measured XYZ value to the target XYZ value, and the calculated correction coefficient is input to the display panel 200 and used to correct chromaticity and luminance characteristics of each light source. Accordingly, as illustrated in FIG. 3B, each pixel of the display panel 200 may be able to express uniform chromaticity and luminance.

However, the method of measuring the XYZ value for each pixel of the display panel 200 using the colorimeter 40 had a disadvantage in that it cannot be used in all display panels having different types of light sources. Since the color filter of the colorimeter 40 reflects the CMF according to the characteristics of a specific type of light source, a colorimeter with another color filter was needed to measure chromaticity and luminance of a light source with a different type other than a light source of the corresponding specific type. That is, a colorimeter having a plurality of different color filters was required to measure chromaticity and luminance of a display panel having a plurality of different types of light sources.

The electronic device 100 of the disclosure, without physically implementing the color filter, may store the spectral information of the CMF, and acquire the XYZ value regarding each pixel of the display panel by using the stored spectral information and the spectral information of each pixel of the display panel, and furthermore, may store the pre-defined CMF by type of different light sources and acquire the XYZ value by using a CMF corresponding to types of respective light sources of the display panel. The correction coefficient for each pixel of the display panel may be calculated based on the acquired XYZ value.

Hereinafter, a method of acquiring XYZ values of respective light sources of the display panel using CMFs corresponding to the light source types of the display panel will be described in detail with reference to FIGS. 5A to 5C.

Figure 5A:
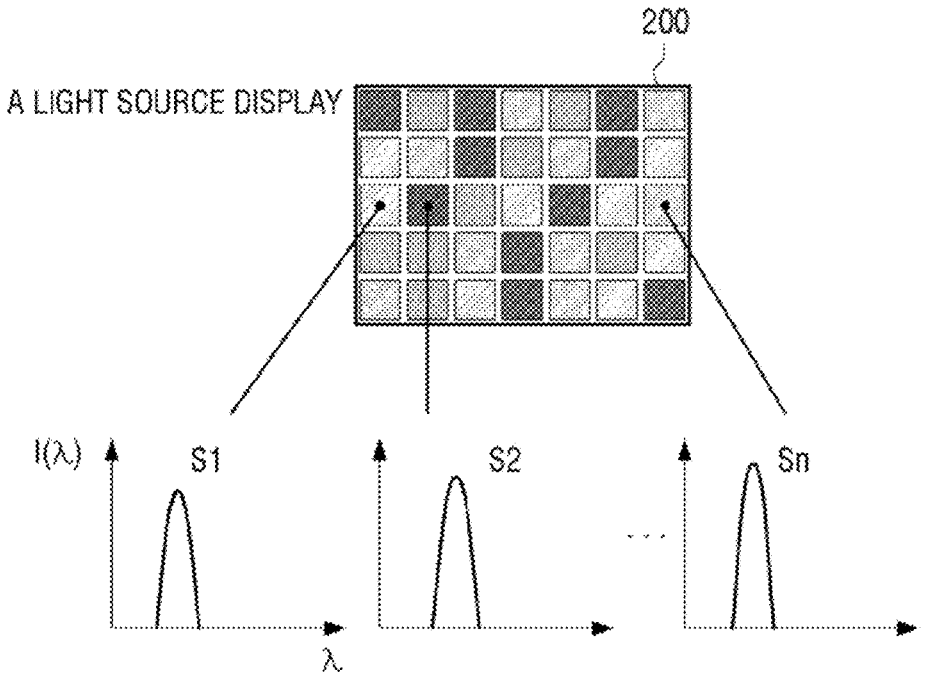
FIGS. 5A to 5C are views illustrating a method for measuring color stimulus value of a point light source according to an embodiment.
Figure 5B:
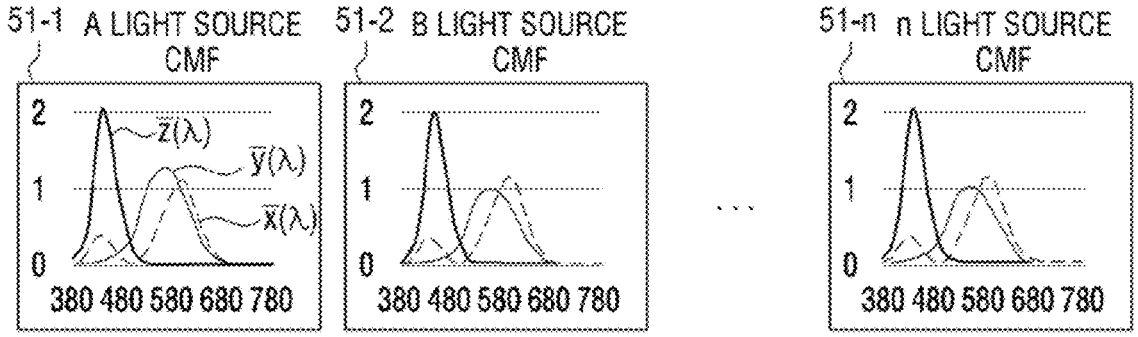
Figure 5C:
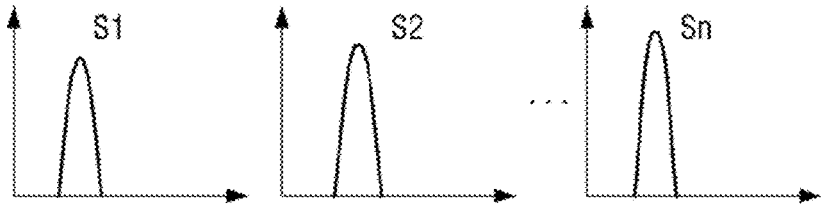
Figure 5C:
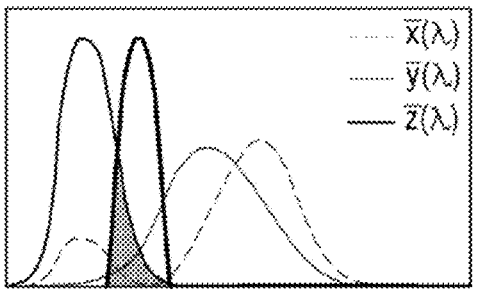

FIGS. 5A to 5C are views illustrating a method for measuring color stimulus value of a point light source according to an embodiment.

As illustrated in FIG. 5A, with respect to the display panel 200, which is a type of a point light source is A, the sensor 110 of the electronic device 100 measures spectra for R, G, B, respectively, of each pixel of the display panel 200. Based on the measured spectra, the processor 120 may acquire spectral information on R, G, and B, respectively, for each pixel of the display panel 200. FIG. 5A is a graph showing spectral information (S1 to Sn) for R of respective pixels.

Since chromaticity and luminance of each pixel of the display panel 200 are different from each other, the spectral graph of each pixel may also be shown differently as illustrated in FIG. 5A.

Meanwhile, the storage unit 120 of the electronic device 100 may store a plurality of different CMFs pre-defined according to characteristics of respective light sources. For example, as illustrated in FIG. 5B, the storage unit 120 may store CMFs corresponding to characteristics of an A type light source to an n type light source (51-1 to 51-*n*), respectively.

In this case, the processor 130 may select a CMF corresponding to the light source of the display panel 200 among the plurality of CMFs (51-1 to 51-*n*). A method for selecting the CMF may be implemented in various ways.

According to an embodiment, the processor 130 may select a CMF of a light source having a spectral characteristic most similar to spectral information of at least one among spectral information for each acquired pixel as a CMF corresponding to a light source of the display panel 200. The spectral information (S1 to Sn) for each pixel is slightly different, but is generally similar as it includes a common type of light sources. Thus, the processor 130 may select a CMF of a light source having spectral information most similar to spectral information (S1 to Sn) of each pixel among the plurality of CMFs stored in the storage unit 120.

In order to compare the spectral information, the storage unit 120 may further store a plurality of light source spectral information pre-defined by type of light source having different characteristics. In other words, the CMF and the light source spectral information may be matched by type, respectively, and be stored in the storage unit 120.

Figure 7:
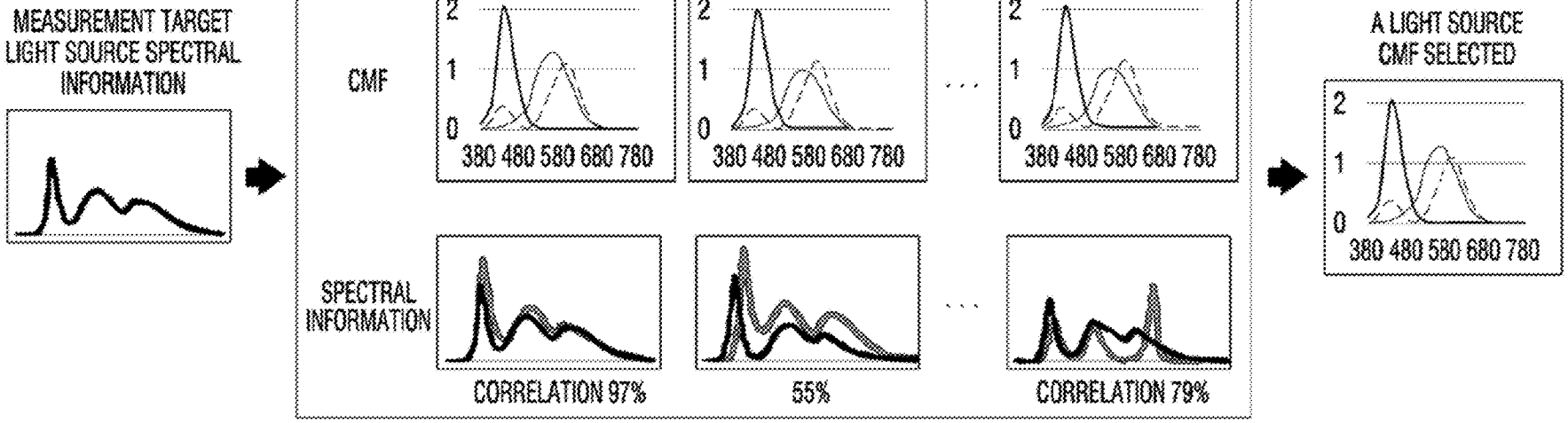
FIG. 7 is a view illustrating a method for selecting one CMF among stored CMFs according to spectral information.

As illustrated in FIG. 7, the processor 130 may calculate at least one spectral information among the spectral information (S1 to Sn) regarding each pixel acquired and a correlation between light source information by type stored in the storage unit 120, respectively. The processor 130 may select the A light source having the light source spectral information indicating the highest correlation (97%) with the acquired at least one spectral information among the plurality of stored light source spectral information, and select the CMF of the selected A light source as a CMF corresponding to the A light source of the display panel 200. Since a method for calculating the correlation between the two data is widely known, a detailed description will be omitted.

Figure 8:
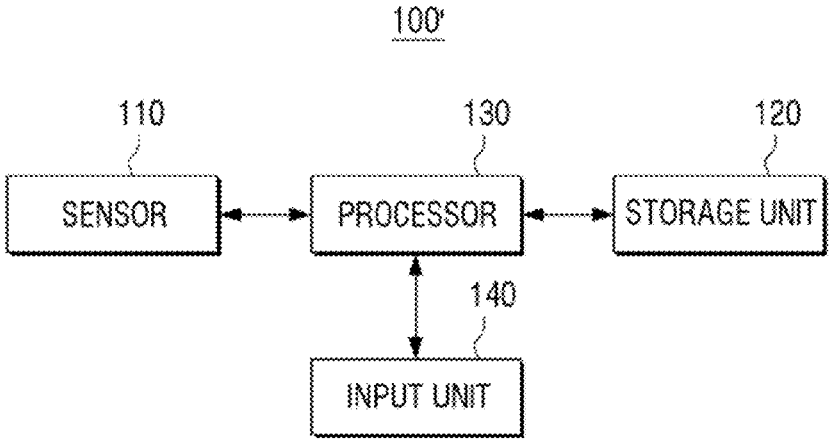
FIG. 8 is a block diagram schematically illustrating a configuration of an electronic device according to another embodiment.

Meanwhile, the processor 130 may select the CMF selected by the user among a plurality of stored CMFs 51-1 to 51-*n*. To this end, the electronic device 100' according to another embodiment of the disclosure may further include an input unit 140 that may receive a user input for selecting a CMF, as shown in FIG. 8. The input unit 140 may be implemented as a well-known configuration such as a physical button, a keypad, a touch panel, or the like, and may be obviously understood in the art, and thus a detailed description thereof will be omitted.

The selected CMF may be represented by a graph indicating spectral information of the tristimulus value functions x (λ), y (λ), z (λ).

Meanwhile, as shown in FIG. 5C, the processor 130 may integrate the spectral information (S1~Sn) for an R of each pixel and a product of the color stimulus value functions x (λ), y (λ), z (λ) of the selected CMF, respectively, to calculate the color stimulus values X, Y and Z for the R of each pixel. Specifically, the processor 130 may multiply the spectral information S1 of R of a first pixel and the color stimulus value functions x (λ), y (λ), and z (λ) of the stored CMF by preset wavelength unit (1 nm or 5 nm, etc.), respectively, to calculate the color stimulus values X, Y, and Z for R of the first pixel by adding the multiplied values.

Likewise, the processor 130 may integrate the multiplication of the spectral information S1 to Sn for G of each pixel and the color stimulus value functions x (λ), y (λ), and z (λ) of the selected CMF, respectively, to calculate the color stimulus values X, Y, and Z for G of each pixel. In addition, the processor 130 may integrate the multiplication of the spectral information S1 to Sn for B of each pixel and the color stimulus value functions x (λ), y (λ), and z (λ) of the selected CMF, respectively, to calculate the color stimulus values X, Y, and Z for B of each pixel.

Figure 6:
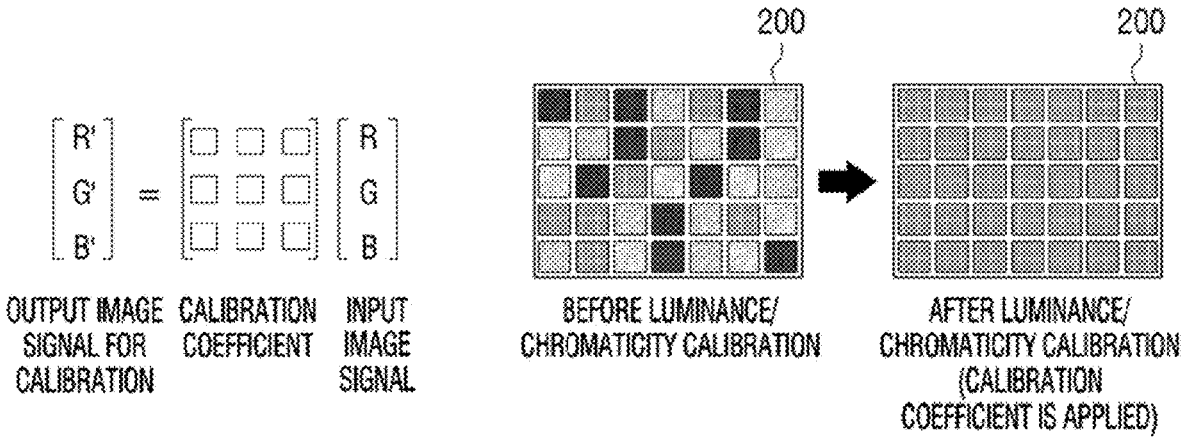
FIG. 6 is a view illustrating a method for correcting chromaticity and luminance of a point light source by using measured color stimulus values of the point light source according to an embodiment.

The processor 130 may use the color stimulus values X, Y, and Z for the acquired R, G, and B of each pixel and target color stimulus values X', Y', and Z' pre-stored in the storage unit 120 to calculate the correction coefficients for correcting the color stimulus values X, Y, and Z of each pixel. As shown in FIG. 6, the processor 130 may calculate correction coefficient with a 3×3 matrix data form that converts input video signals R, G, and B into output video signals R', G', and B' for correcting to convert the color stimulus values X, Y, and Z of each pixel outputting an image signal input to the display panel 200 to be measured into the target color stimulus values X', Y', and Z'.

The calculated correction coefficient may be input to the display panel 200 to uniformly correct luminance and color of each pixel of the display panel 200.

Figure 9:
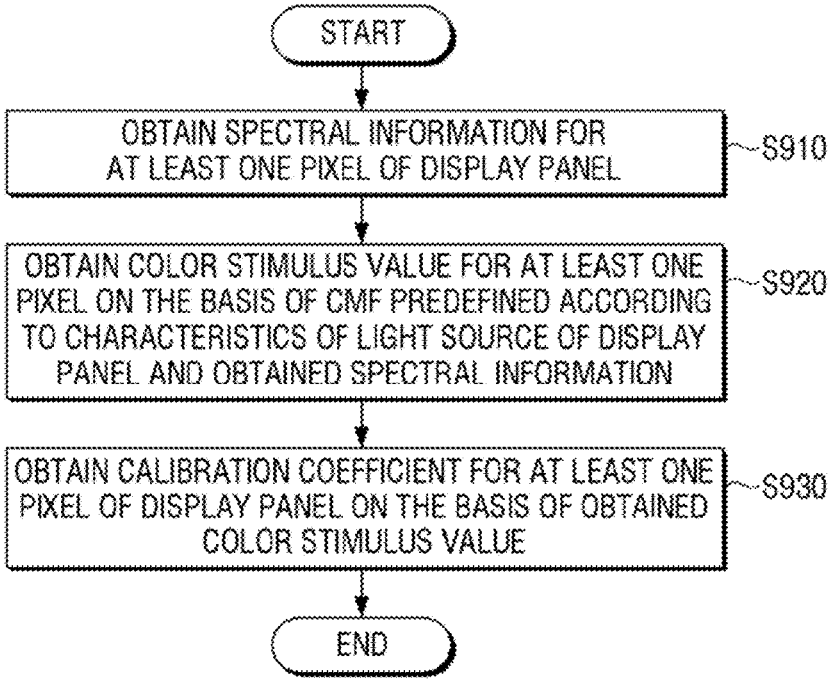
FIG. 9 is a flowchart illustrating a method for controlling an electronic device according to an embodiment of the disclosure

FIG. 9 is a flowchart illustrating a method for controlling an electronic device according to an embodiment of the disclosure.

Firstly, spectral information on at least one pixel of the display panel is acquired (S910).

Thereafter, color stimulus values for at least one pixel are acquired based on the CMF and the acquired spectral information pre-defined according to characteristics of the light source of the display panel (S920). In this case, the CMF corresponding to the light source of the display panel may be selected among the CMFs pre-defined by type for each light source having different characteristics from each other, and the color stimulus values regarding at least one pixel may be acquired based on the selected CMF and the acquired spectral information. Specifically, the spectral information acquired by each predetermined wavelength unit and the color stimulus values regarding at least one pixel may be acquired by weighted summing up with the stored CMF data.

Particularly, the CMF corresponding to the light source having the highest correlation may be selected as a CMF corresponding to the light source of the display panel by calculating a correlation between the acquired spectral information regarding at least one pixel and the spectral information by the stored light source.

In another embodiment, a user may directly select a CMF suitable for a light source of a display panel among a plurality of stored CMFs.

Thereafter, a correction coefficient regarding at least one pixel of the display panel is acquired based on the acquired color stimulus values (S930). In this case, based on the acquired color stimulus values regarding at least one pixel and the predetermined target color stimulus values, a correction coefficient for correcting the color stimulus values regarding the acquired at least one pixel may be calculated by pixel unit.

According to various embodiments of the disclosure, when measuring the chromaticity and the luminance of the light source, the CMF corresponding to the light source to be measured does not need to be implemented as a color filter, respectively, and cost reduction and an increase of convenience may be occurred by calculating in software.

The method for controlling an electronic device according to various embodiments described above may be implemented as a program and stored in various recording media. In other words, a computer program which is processed by various processors to execute the above-described various control methods may be stored and used in a recording medium.

For example, a non-transitory computer readable medium may be provided that stores a program the performs acquiring spectral information regarding at least one pixel of the display panel, acquiring color stimulus values regarding at least one pixel based on the CMF pre-defined according to characteristics of the light source of the display panel and the acquired spectral information, acquiring a correction coefficient regarding at least one pixel of the display panel based on the acquired color stimulus values.

The non-transitory computer readable recording medium refers to a medium that stores data and that can be read by devices. In detail, the above-described various applications or programs may be stored in the non-transitory computer readable medium, for example, a compact disc (CD), a digital versatile disc (DVD), a hard disc, a Blu-ray disc, a universal serial bus (USB), a memory card, a read only memory (ROM), and the like, and may be provided.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a sensor;

a storage unit storing color matching functions (CMFs) and light source spectral information which correspond to types of the light sources having different characteristics; and a processor configured to:

acquire spectral information regarding a pixel of a display panel by using the sensor, identify light source spectral information from among the stored light source spectral information based on a correlation between the acquired spectral information and the stored light source spectral information, identify a CMF corresponding to the identified light source spectral information from among the stored CMFs based on a type of a light source corresponding to the identified light source spectral information from among the types of the light sources, identify the identified CMF as a CMF corresponding to a type of a light source of the display panel, acquire color stimulus values regarding the pixel based on the identified CMF corresponding to the light source of the display panel and the acquired spectral information, and acquire a correction coefficient regarding the pixel based on the acquired color stimulus values.

2. The electronic device of claim 1, the electronic device further comprising an input unit, wherein the processor is configured to identify a CMF selected according to a user input through the input unit from among the stored CMFs as the CMF corresponding to the type of the light source of the display panel.

3. The electronic device of claim 1, wherein the processor is configured to, based on the acquired color stimulus values regarding the pixel and a preset target color stimulus value, calculate correction coefficients for correcting the acquired color stimulus values regarding the pixel and store the calculated correction coefficients in the storage unit.

4. The electronic device of claim 1, wherein the pixel comprises point light sources corresponding to red (R), green (G), blue (B), respectively, and wherein the processor is configured to acquire spectral information and color stimulus values regarding the R, G, and B, respectively.

5. An electronic device comprising:

a sensor;

a storage unit storing a color matching function (CMF) which has been pre-defined according to characteristics of a light source; and a processor configured to:

acquire spectral information regarding at least one pixel of a display panel by using the sensor, acquire color stimulus values regarding the at least one pixel on the basis of the stored CMF and the acquired spectral information, and acquire a correction coefficient regarding at least one pixel of the display panel on the basis of the acquired color stimulus values, wherein the processor is configured to acquire the color stimulus values regarding the at least one pixel by adding up a multiplication of the color stimulus values of the stored CMF and the color stimulus values of the acquired spectral information.

6. A method for controlling electronic device, the method comprising:

acquiring spectral information regarding at least one pixel of a display panel;

identifying a color matching function (CMF) corresponding to a type of a light source of the display panel from among CMFs stored in the electronic device, the CMFs corresponding to types of light sources having different characteristics;

acquiring color stimulus values regarding the pixel based on the identified CMF and the acquired spectral information; and acquiring a correction coefficient regarding the pixel of the display panel based on the acquired color stimulus values, wherein the identifying comprises identifying light source spectral information from among the stored light source spectral information based on a correlation between the acquired spectral information and the stored light source spectral information, identifying a CMF corresponding to the identified light source spectral information from among the stored CMFs based on a type of a light source corresponding to the identified light source spectral information from among the types of the light sources, and identifying the identified CMF as the CMF corresponding to the type of the light source of the display panel.

7. The method of claim 6, wherein the identifying comprises identifying a CMF selected according to a user input from among the stored CMFs as the CMF corresponding to the type of the light source of the display panel.

8. The method of claim 6, wherein the acquiring the correction coefficient comprises, based on the acquired color stimulus values regarding the pixel and a preset target color stimulus value, calculating a correction coefficient for correcting the acquired color stimulus values regarding the pixel by the pixel unit.

9. The method of claim 6, wherein the acquiring color stimulus values comprises acquiring the color stimulus values regarding the pixel by adding up a multiplication of the color stimulus value of the stored CMF and the color stimulus value of the acquired spectral information by a preset wavelength unit.

10. The method of claim 6, wherein the pixel comprises point light sources corresponding to red (R), green (G), and blue (B), respectively, and wherein the acquiring the color stimulus values comprises acquiring spectral information and color stimulus values regarding the R, G, and B, respectively.

* * * * *